US005722018A

United States Patent [19]

Hart et al.

[11] Patent Number: 5,722,018

[45] Date of Patent: Feb. 24, 1998

[54] VIBRATION REDUCING MOUNTING SYSTEM FOR TONER FILTERS

[75] Inventors: Steven C. Hart; Cyril G. Edmunds, both of Webster, N.Y.

[73] Assignee: Xerox Corporation, Stamford, Conn.

[21] Appl. No.: 697,550

[22] Filed: Aug. 27, 1996

[51] Int. Cl.[6] ..... G03G 21/00

[52] U.S. Cl. ..... 399/258; 399/261

[58] Field of Search ..... 399/258, 260, 399/261, 358, 359, 99

[56] References Cited

U.S. PATENT DOCUMENTS 5,563,697 10/1996 Saito ..... 399/358

FOREIGN PATENT DOCUMENTS 5-142901 6/1993 Japan .
7-325470 12/1995 Japan .

*Primary Examiner*—Nestor R. Ramirez

*Attorney, Agent, or Firm*—Lloyd F. Bean, II

[57] ABSTRACT

A color electrophotographic printing machine, wherein an electrostatic latent image recorded on a photoconductive member is developed with toner of a first color and toner of a second color to form a visible image thereof, the electrophotographic printing machine including a system, for removing contaminates from toner of a first color and toner of a second color moving from a toner dispenser to a developer housing, the system including: a mounting assembly, a filter system mounted on the mounting assembly, the filter system having a screen for permitting toner of the first color to travel therethrough while inhibiting contaminants from traveling therethrough when vibrated; a first vibration driver, operatively connected to the screen, for vibrating the screen; a second filter system mounted on the mounting assembly, the filter system having a screen for permitting toner of the second color to travel therethrough while inhibiting contaminants from traveling therethrough when vibrated; and a second vibration driver being operatively connected to vibrate the screen, and coacting with the first vibration driver, for damping ocillation of the mounting assembly.

17 Claims, 5 Drawing Sheets

VIBRATION REDUCING MOUNTING SYSTEM FOR TONER FILTERS

This invention relates generally to a development apparatus for ionographic or electrophotographic imaging and printing apparatuses and machines, and more particularly is directed to a phase cancellation mounting configuration for toner filters.

Generally, the process of electrophotographic printing includes charging a photoconductive member to a substantially uniform potential so as to sensitize the surface thereof. The charged portion of the photoconductive surface is exposed to a light image from either a digital imaging system [for example a scanning laser beam] or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes, that is sequentially develops, toner powder images of different color toners onto the photoreceptor prior to the transfer of the composite toner powder image onto the substrate. While the image on image process has advantages over other methods for producing color images, it has its own unique set of requirements. One such requirement is for non interactive development systems, is that those that do not scavenge or otherwise disturb a previously toned image.

Since development systems, such as conventional two component magnetic brush development and AC jumping single component development are known to disturb toner images, they are not in general suited for use in an image on image system. Thus there is a need for noninteractive development systems. There are several types of non interactive development systems that can be selected for use in an image on image system. Most use a donor roll for transporting charged toner to the development nip; the development nip is defined as the interface region between the donor roll and photoconductive member. In the development nip, the toner is developed on the latent image recorded on the photoconductive member by a combination of mechanical and/or electrical forces. It is the method by which the toner is induced to leave the donor member which primarily differentiates the several options from each other; both single component and two component methods can be utilized for loading toner onto the donor member.

In one version of a non interactive development system, a plurality of electrode wires are closely spaced from the toned donor roll in the development zone. An AC voltage is applied to the wires to generate a toner cloud in the development zone. The electrostatic fields associated with the latent image attract toner from the toner cloud to develop the latent image. It is this configuration which is utilized in both "Scavengeless Development" and "Hybrid Scavengeless Development"

In another version of non interactive development, interdigitated electrodes are provided within the surface of a donor roll. The application of an AC bias between the adjacent electrodes in the development zone causes the generation of a toner cloud.

Another type of development technology, known as jumping development, may also be configured to be non interactive. In jumping development, voltages are applied between a donor roll and the substrate of the photoreceptor member. In one version of jumping development, only a DC voltage is applied to the donor roll to prevent toner deposition in the non-image areas. In the image areas, the electric field from the closely spaced photoreceptor attracts toner from the donor. In another version of jumping development, an AC voltage is superimposed on the DC voltage for detaching toner from the donor roll and projecting the toner toward the photoconductive member so that the electrostatic fields associated with the latent image attract the toner to develop the latent image.

In the system herein before described, it has become highly desirable to have a toner filtering system to remove contamination, particularly in the form of clothing and paper fibers, before the toner reaches the developer housing, to obviate copy quality and machine reliability problems. Also it is desirable to prevent toner particles from adhering together into large scale clumps which ride on the top of the developer material in the developer housing negatively effecting the blending and admixing of the incoming toner. An exemplary toner filtering system of this type is disclosed in U.S. patent application Ser. No. 08/474,861 filed Jun. 6, 1995, entitled, "Multi-Layer Toner Filtration Trap". It has been found in such a system that even though contamination is removed, vibration generated by the system leads to image noise and image banding.

SUMMARY OF THE INVENTION

Briefly, the present invention obviates the problems noted above by utilizing a pair of filtering systems mounted as a single assembly. The mounting mechanism attaching the assembly from its center of mass to the machine as a whole. The filtering systems are then vibrated in a manner such that the motions of the two filters are equal in magnitude and opposite in direction. To the extent that the reaction forces acting on the center of mass are equal in magnitude and opposite in direction, the vibration of the center of mass will be reduced to zero. Thus there will be no vibration introduced into the machine as a whole and the above stated problem is eliminated.

One aspect of the invention provides a system for removing contaminates from toner comprising a mounting assembly; a filter system mounted on said mounting assembly, said filter system having a screen for permitting toner to travel therethrough while inhibiting contaminants from traveling therethrough when vibrated; a first vibration driver, operatively connected to said screen, for vibrating said screen; and a second vibration driver coacting with said first vibration driver, for damping ocillation of said mounting assembly.

Another aspect of the invention provides an electrophotographic printing machine, wherein an electrostatic latent image recorded on a photoconductive member is developed to form a visible image thereof, said electrophotographic printing machine including a system, for removing contaminates from toner moving from a toner dispenser to a developer housing, the system comprising: a mounting assembly; a filter system mounted on said mounting assembly, said filter system having a screen for permitting toner to travel therethrough while inhibiting contaminants from traveling therethrough when vibrated; a first vibration driver, operatively connected to said screen, for vibrating said screen; and a second vibration driver coacting with said first vibration driver, for damping ocillation of said filter system mounted to said mounting assembly.

Yet another aspect of the invention provides a color electrophotographic printing machine, wherein an electrostatic latent image recorded on a photoconductive member is developed with toner of a first color and toner of a second color to form a visible image thereof, said electrophotographic printing machine including a system, for removing contaminates from toner of a first color and toner of a second color moving from a toner dispenser to a developer housing, the system comprising: a mounting assembly; a filter system mounted on said mounting assembly, said filter system having a screen for permitting toner of said first color to travel therethrough while inhibiting contaminants from traveling therethrough when vibrated; a first vibration driver, operatively connected to said screen, for vibrating said screen; a second filter system mounted on said mounting assembly, said filter system having a screen for permitting toner of said second color to travel therethrough while inhibiting contaminants from traveling therethrough when vibrated; and a second vibration driver being operatively connected to vibrate said screen, and coacting with said first vibration driver, for damping ocillation of said mounting assembly.

Inasmuch as the art of electrophotographic printing is well known, the various processing stations employed in the printing machine will be shown hereinafter schematically and their operation described briefly with reference thereto.

Figure 1:
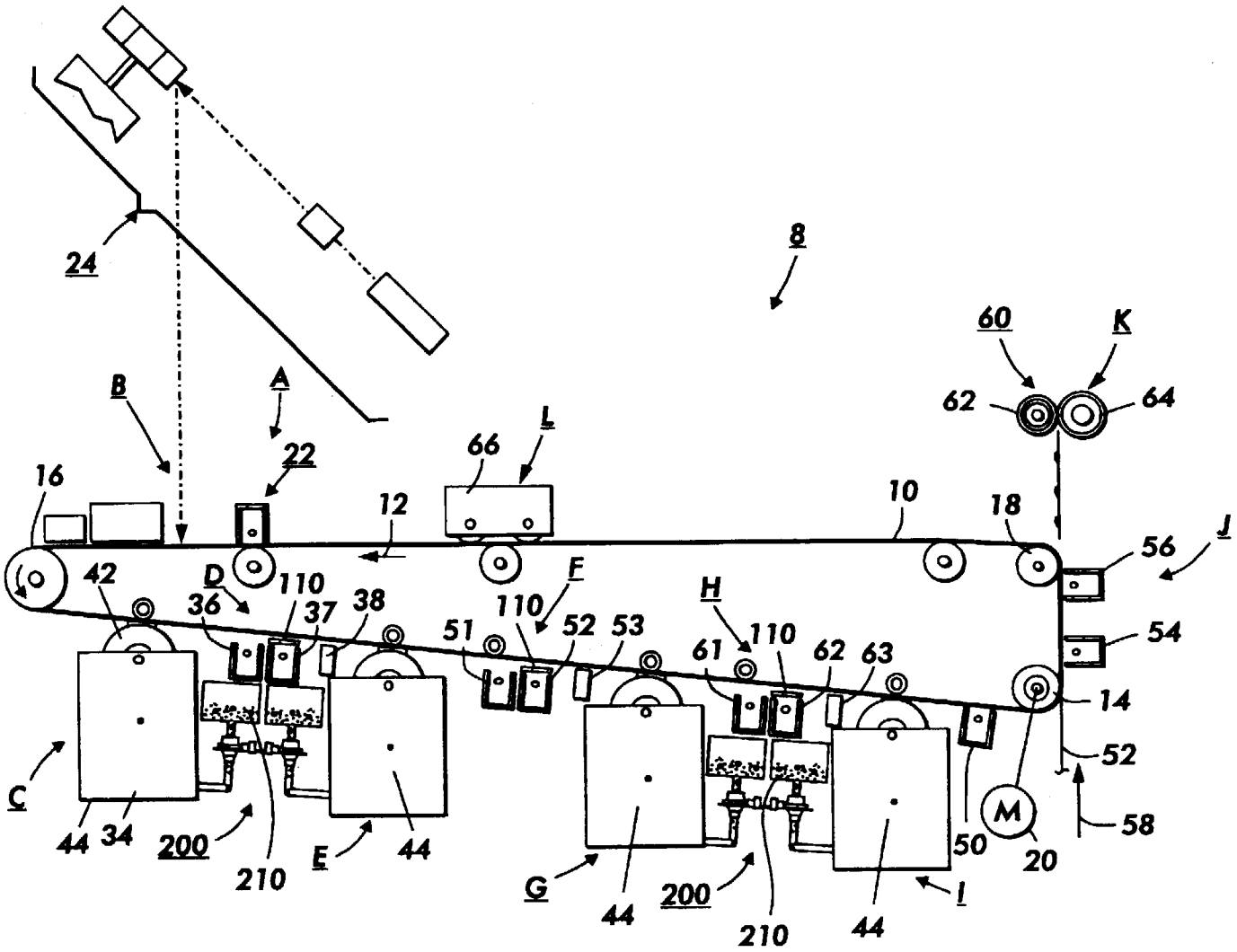
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
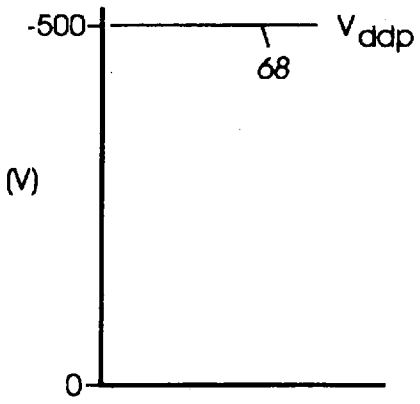
FIG. 2A shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
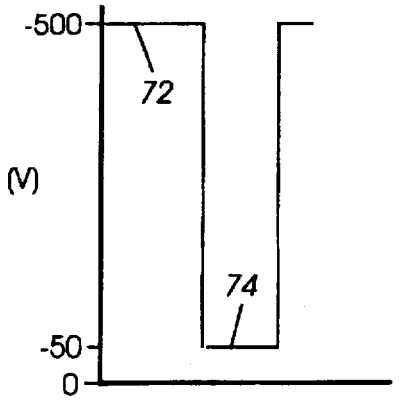
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first housing can be interactive, and thus does not have to be "Scavengeless". For purposes of this description, all four development stations are assumed to be of a non interactive nature, and all are assumed to be identical in physical configuration. The first development station C deposits a first color, say black, of negatively charged toner 31 onto the image area. That toner is attracted to the less negative sections of the image area and repelled by the more negative sections. The result is a first toner powder image on the image area.

For the first development station C, development system 34 includes a donor roll 42. An electrode structure, (not shown), is electrically biased with an AC and a DC voltage relative to donor roll 42 for the purpose of detaching toner therefrom so as to form a toner powder cloud in the gap between the donor roll and photoconductive surface. Both electrode structure and donor roll 42 are biased at DC potentials for discharge area development (DAD). The discharged photoreceptor image attracts toner particles from the toner powder cloud to form a toner powder image thereon.

As successive electrostatic latent images are developed, the toner particles within the developer material are depleted. A toner dispenser 210 stores a supply of toner particles. The toner dispenser is in communication with a chamber of housing 44. As the concentration of toner particles in the developer material is decreased, fresh toner particles are furnished to the developer material in the chamber via toner filter 90 from the toner dispenser 210. The augers in the chamber of the housing mix the fresh toner particles with the remaining developer material so that the resultant developer material therein is substantially uniform with the concentration of toner particles being optimized. In this manner, a substantially constant amount of toner particles are in the chamber of the developer housing with the toner particles having a constant charge.

Figure 2C:
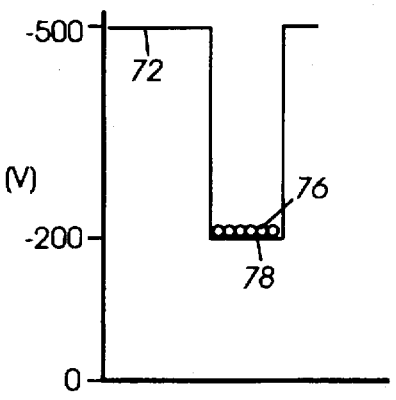
FIG. 2C shows a typical voltage profile of the image area after being developed.

FIG. 2C shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The un-illuminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
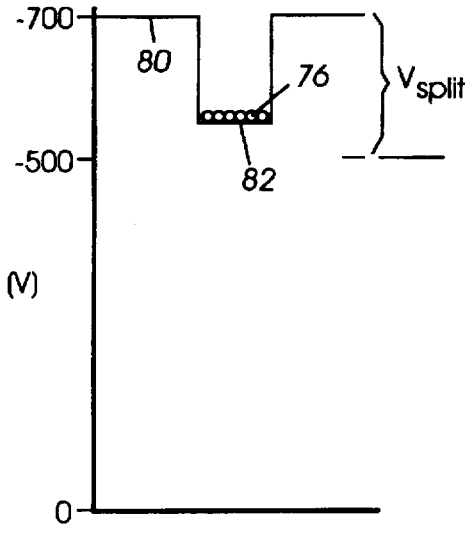
FIG. 2D shows a typical voltage profile of the image area after being recharged by a first recharging device.

FIG. 2D shows the voltages on the image area after it passes through the first recharging device 36. The first recharging device overcharges the image area to higher negative levels than that which the image area is to have when it leaves the recharging station D. For example, as shown in FIG. 2D, the untoned parts of the image area reach a voltage level 80 of about −700 volts while the toned parts, so (represented by toner 76), reach a voltage level 82 of about −550 volts. The first recharging device 36 is preferably a DC scorotron.

Figure 2E:
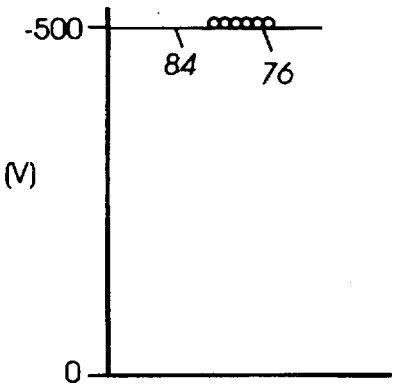
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
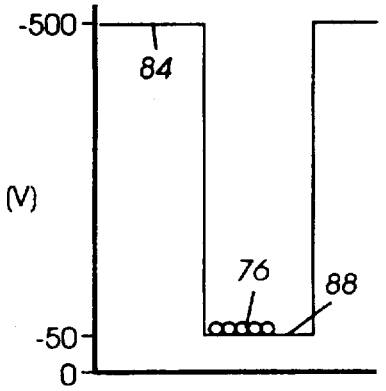
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is functionally the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 53 is the same in function as the first and second exposure stations 24 and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same in function as the first, second, and third exposure stations, 24, 38, and 53 respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the back of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 3:
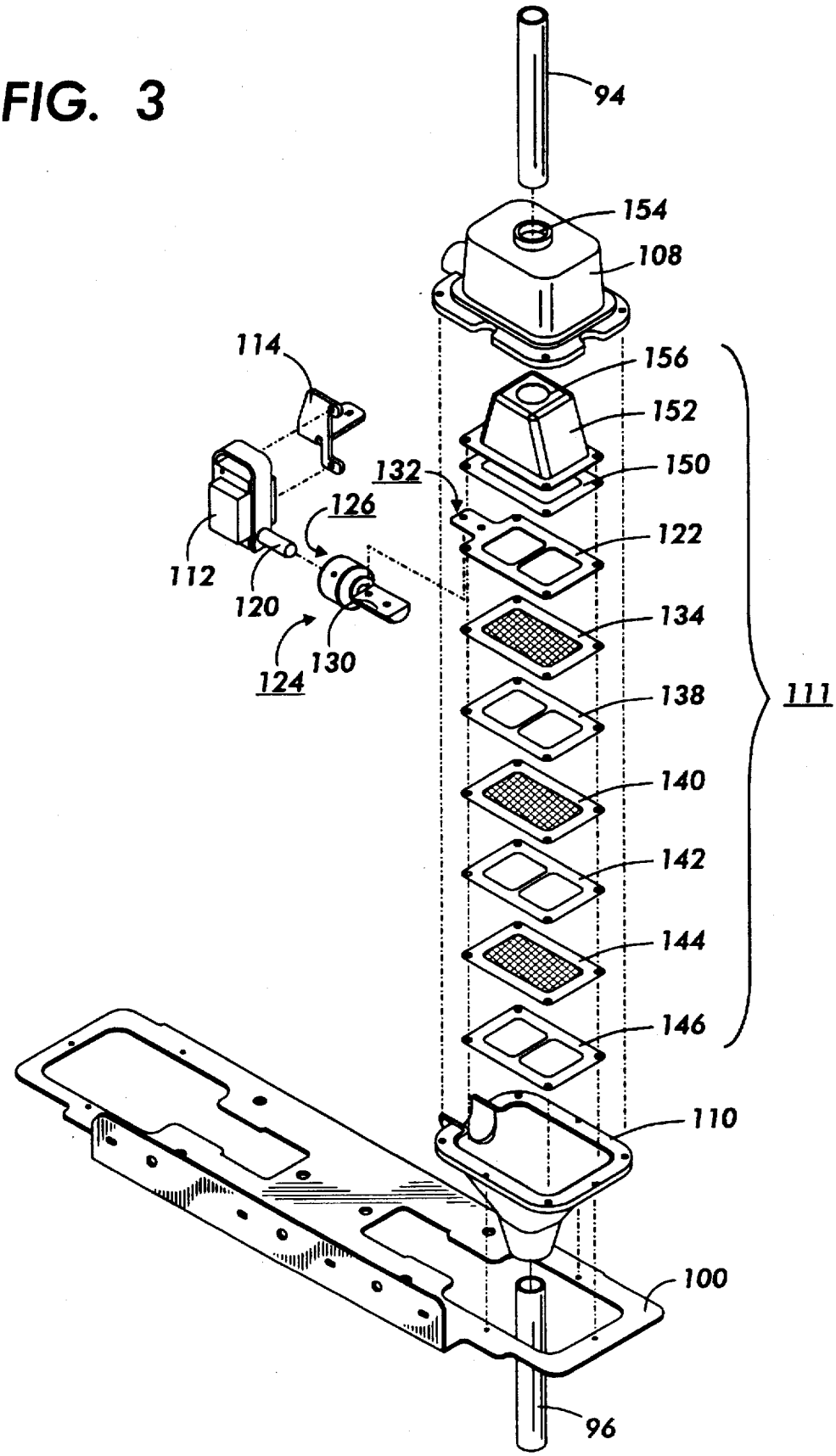
FIG. 3 is an exploded perspective view of the filter according to the present invention.
Figure 4:
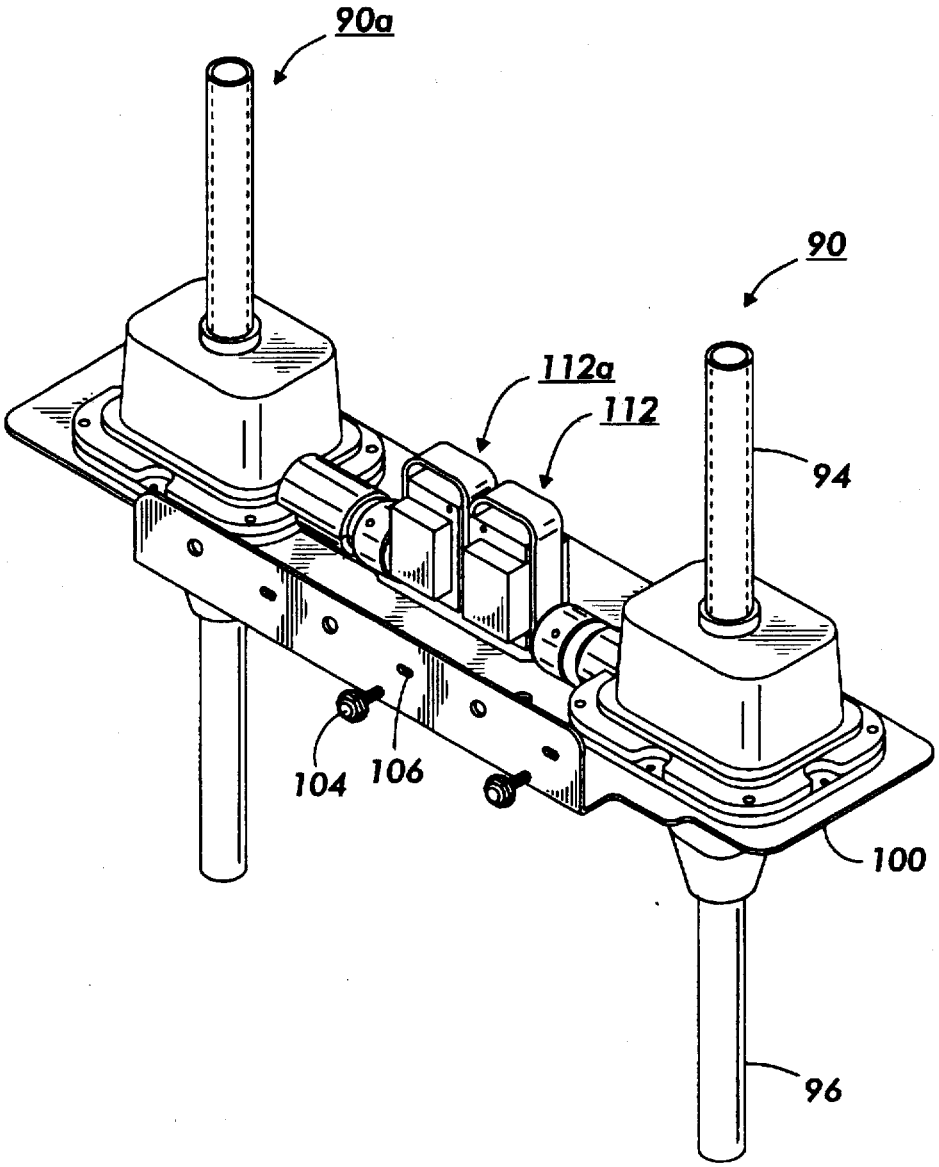
FIG. 4 is a perspective view of a multi layer screen filter according to the present invention.
Figure 5:
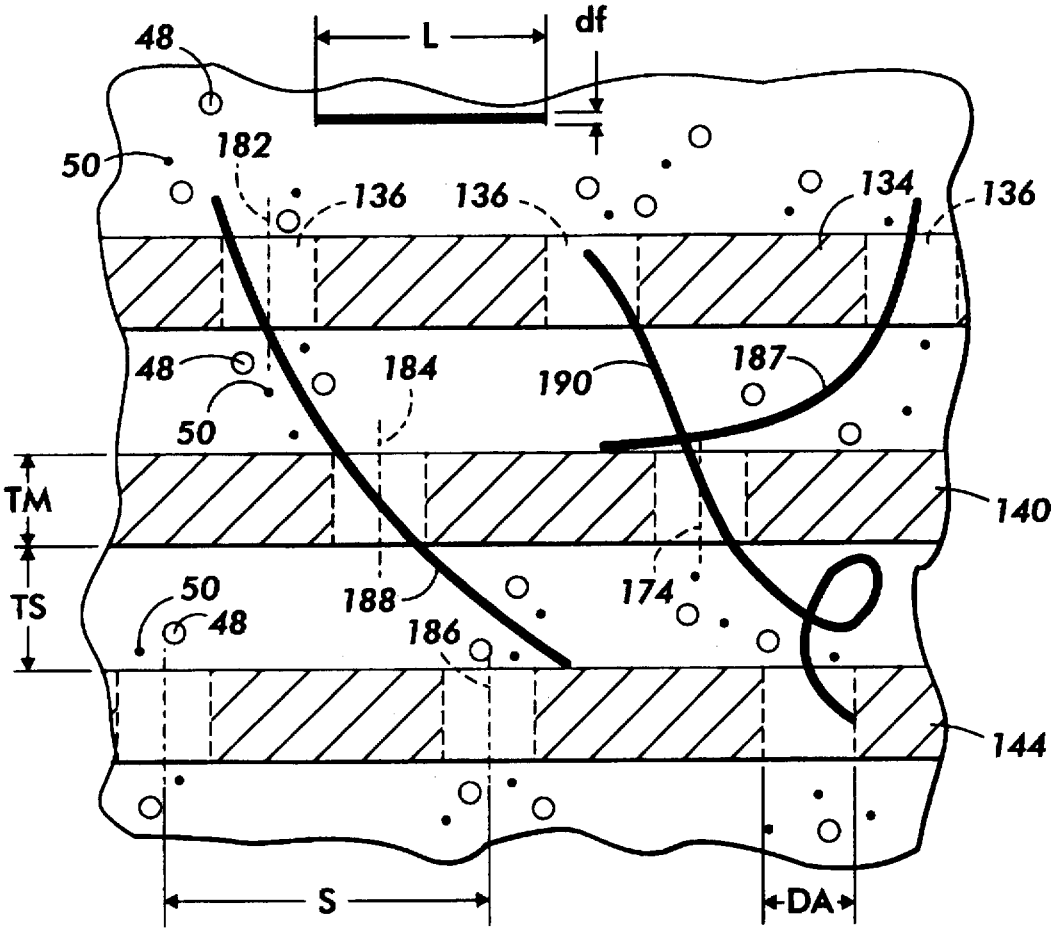
FIG. 5 is a partial sectional view of the plates and spacers of the filter of FIG. 4 showing the position of the apertures.

Referring now to FIGS. 3–5, illustrating symmetric paired toner filters 90 and 90*a*, apparatus 90 is shown in greater detail. The apparatus 90 includes mounting bracket 100 which is connected to copier frame by any suitable means. For example, the mounting bracket may be connected to the frame by fasteners in the form of screws 104 which fit through openings 106 of the mounting brackets 100 and are threadedly secured to the copier frame. A filter housing assembly is secured to mounting bracket 100. The filter housing assembly is composed of an upper filter housing body 108 and a lower filter housing body 110. Inside the filter housing assembly is a filter screen assembly 111 (composed of components 122, 134, 138, 140, 142, 144, 146, 150, and 152), which is connected to a vibration driving devices 112 and 112*a*.

The vibration driving devices 112 and 112*a* preferably are in the form of a mechanical vibrator. The mechanical vibrators may be any suitable vibrator such as those commercially available. The vibrators 112 and 112*a* induce vibration into the filter screen assembly 111.

Now referring to FIG. 4, for illustrative clarity only one filter unit 90 is shown with the components of the apparatus separated in an exploded view. The mechanical vibrator 112 and 112*a* are secured by vibrator mounting bracket assembly 114 to the mounting bracket 100. It is desirable that the vibrator mounting bracket assembly 114 include some elastomeric mount, (not shown), for isolating the mechanical vibration of the vibration drivers 112 and 112*a* and the filter screen assembly 111 from the mounting bracket 100. The present invention utilizes pairs of toner filtration units mounted such that the vibration vectors for the two screen arrays are of equal magnitude and opposite sign. The units are excited with exactly the same frequency. This provides a configuration with no net motion of the center of mass. Hence, no vibration coupling to the machine frames. In actual practice there will be some small vibration of the center of mass because the two vibration drivers will not be exactly balanced. However, when compared to a single vibration driver mounting approach, this approach provides several orders of magnitude reduction in the amount of vibration which must be damped by the elastomeric mount. The vibrator mounting bracket assembly 114 may be made of any combination of suitable durable material such as steel stampings or plastics.

Extending from mechanical vibrator 112 is a mounting stem 120. The vibrator 112 and the stem 120 vibrate when the vibrator 112 is engaged. Mounting stem 120 is connected to an upper screen mounting plate 122 by any suitable means such as adaptor 124. The upper screen mounting plate 122 and the adaptor 124 are made of any suitable durable rigid material such as plastic or a metal. The adaptor 124 includes an opening 126 to which stem 120 matingly fits and a flat surface 130 to which protruding tab 132 of the upper screen mounting plate 122 matingly fits.

A first filter screen plate 134 is placed below the upper screen mounting plate 122. The filter screen plate 134 is made of a thin durable material with numerous small openings 136.

This screen 134 may be fabricated from a thin metal foil or plastic film with the openings formed by any suitable means such as chemical etching, laser machining, or punching. Alternatively, this screen may be fabricated from a woven plastic or metal wire mesh. Yet another method for formation of this screen is the process of electrodeposition of metals.

Placed below the first filter screen plate 134 is a screen spacer 138. The spacer 138 may be made of any suitable material but preferably is made of a non compressible material. The screen spacer 138 may be made of any suitable durable material such as metal or plastic.

A second filter screen plate 140 is placed below the first screen spacer 138. A second screen spacer 142 is placed below the second filter screen plate 140. While this invention may be practiced with only two screens, the apparatus 90 preferably includes at least a third filter screen plate 144 which is placed below the second screen spacer 142.

A lower screen mounting plate 134 is next located below the third filter screen plate 144. The lower screen mounting plate 146 is made of any suitable durable rigid material such as plastic or a metal.

Located on top of the upper screen mounting plate 122 are a gasket 150 and a replenisher containment housing 152. The gasket 150 can be fabricated from any suitable material such as a foam rubber. The replenisher containment housing 152 is typically fabricated from a plastic material.

When the apparatus is assembled, the toner inlet conduit supply pipe 94 passes through and is sealed to an opening 154 in the upper filter housing body 108. The toner inlet conduit supply pipe 94 passes through an opening 156 in the replenisher containment housing 152 without touching the housing 152. There can optionally be a thin elastomeric diaphragm seal (not shown) between the toner inlet supply pipe 94 and the replenisher containment housing 152. If such a diaphragm seal is implemented, it should be designed so as not to impede the vibration of the filter screen assembly 111. Additionally there is a tubular membrane seal (not shown) between the filter housing assembly 107 and the adapter 124.

In the operation of the apparatus 90, (referring to FIG. 5), one end of a fibrous contaminant, for example in the form of a fiber 187, 188, or 190, to be filtered from the replenisher 78 enters an aperture 136 in the first screen plate-134. Since the diameter $D_f$ of the fiber 187, 188 or 190 is smaller than the diameter $D_a$ of the aperture, the fiber passes through the aperture 136 of the first screen plate 134. At this point the end of the fiber will either encounter the structure of the second filter screen plate 140 or it will encounter an aperture in the second filter screen plate.

For example the fiber 187 encounters the structure of the second filter screen plate 140 and can continue to progress into the space between the first and the second filter screen plates, 134 and 140, respectively. The fiber 187, has a length greater than the distance $T_s$ between the plates 134 and 140, the fiber 187 can not reorient itself in a favorable attitude so as to enter an opening in the second screen plate 140. The fiber 187 is thus trapped between the first and second screen plates 134 and 140 and may not travel further.

For example the leading end of the fibers 188 and 190 encounter an aperture 136 in the second filter screen plate 140. The fiber 188 will continue to progress into the space between the filter screen plates 140 and 144. Here again the fiber can encounter the structure of the third filter screen plate 144 or it can encounter an aperture 136 in the third filter screen plate.

For example the fiber 188 encounters the structure of the third filter screen plate 144, the fiber can, in a fashion similar to that described above, proceed into the region between the second and third filter screen plates 140 and 144. Here because of the inability of the fiber 188 to reorient itself, the fiber 188 will become trapped.

For example the fiber 190 encounters the an aperture 136 in the third filter screen plate 144. The fiber 190 will also most likely become mechanically trapped if it is sufficiently long. Since, by design/fabrication the apertures in the multiple filter screen plates not line up in a straight line, only curved fibers will be able to enter an aperture in the third filter screen plate 144. Thus, only longer fibers with a smooth and constant curvature will be able to progress simultaneously through the apertures 136 in the three filter screen plates 134, 140, and 144. If the fiber is sufficiently long and does not have a uniform curvature, at some point during passage through the apertures, the fiber will become mechanically bound by the plurality of screens.

The replenisher 78 to be filtered includes, on the other hand, toner particles 50 having a size of approximately 7 microns as well as carrier granules 48 having a particle size of approximately 50 microns which are much smaller than the aperture diameter $D_a$. Also, the carrier granules 48 and toner 50 particles are significantly smaller that the spacing between the filter screen plates. This spacing is determined by the thickness of the filter screen spacers. Thus, the carrier granules 48 and toner 50 particles move freely through apertures 136 in both the first screen plate 134 and the second screen plate 140. The filter thereby traps fibers 186, 188, and 190 while permitting toner 50 and carrier particles 48 to freely flow therethrough.

Other embodiments and modifications of the present invention may occur to those skilled in the art subsequent to a review of the information presented herein; these embodiments and modifications, as well as equivalents thereof, are also included within the scope of this invention.

We claim:

1. A system for removing contaminates from toner moving from a toner dispenser to a developer housing, comprising:

a mounting assembly;

a filter system mounted on said mounting assembly, said filter system having a screen for permitting toner to travel therethrough while inhibiting contaminants from traveling therethrough when vibrated;

a first vibration driver, operatively connected to said screen, for vibrating said screen; and a second vibration driver coacting with said first vibration driver, for damping ocillation of said mounting assembly.

2. The system according to claim 1, wherein said first vibration driver vibrates at a first frequency and a first magnitude, and wherein said second vibration driver vibrates at a second frequency and a second magnitude.

3. The system according to claim 2, wherein said first frequency is substantially equal to said second frequency.

4. The system according to claim 2, wherein said first magnitude is substantially equal to and in an opposite direction of said second magnitude.

5. The system according to claim 1, further comprising a second filter system mounted on said mounting-assembly, said second filter system having a screen for permitting toner to travel therethrough while inhibiting contaminants from traveling therethrough when vibrated; and wherein said second vibration driver, is operatively connected to said screen, for vibrating said screen.

6. The system according to claim 5, wherein first and second filtering system are mounted symmetric to each other.

7. An electrophotographic printing machine, wherein an electrostatic latent image recorded on a photoconductive member is developed to form a visible image thereof, said electrophotographic printing machine including a system, for removing contaminates from toner moving from a toner dispenser to a developer housing, the system comprising:

a mounting assembly;

a filter system mounted on said mounting assembly, said filter system having a screen for permitting toner to travel therethrough while inhibiting contaminants from traveling therethrough when vibrated;

a first vibration driver, operatively connected to said screen, for vibrating said screen; and a second vibration driver coacting with said first vibration driver, for damping ocillation of said filter system mounted to said mounting assembly.

8. The system according to claim 7, wherein said first vibration driver vibrates at a first frequency and first magnitude, and wherein said second vibration driver vibrates at a second frequency and a second magnitude.

9. The system according to claim 8, wherein said first frequency is substantially equal to said second frequency.

10. The system according to claim 9, wherein said first magnitude is substantially equal to and in an opposite direction to said second magnitude.

11. The system according to claim 7, further comprising a second filter system mounted on said mounting assembly, said filter system having a screen for permitting toner to travel therethrough while inhibiting contaminants from traveling therethrough when vibrated; and wherein said second vibration driver, being operatively connected to said screen, for vibrating said screen.

12. The system according to claim 4, wherein first and second filtering system are mounted symmetric to each other.

13. A color electrophotographic printing machine, wherein an electrostatic latent image recorded on a photoconductive member is developed with toner of a first color and toner of a second color to form a visible image thereof, said electrophotographic printing machine including a system, for removing contaminates from toner of a first color and toner of a second color moving from a toner dispenser to a developer housing, the system comprising:

a mounting assembly;

a filter system mounted on said mounting assembly, said filter system having a screen for permitting toner of said first color to travel therethrough while inhibiting contaminants from traveling therethrough when vibrated;

a first vibration driver, operatively connected to said screen, for vibrating said screen; a second filter system mounted on said mounting assembly, said filter system having a screen for permitting toner of said second color to travel therethrough while inhibiting contaminants from traveling therethrough when vibrated; and a second vibration driver being operatively connected to vibrate said screen, and coacting with said first vibration driver, for damping ocillation of said mounting assembly.

14. The system according to claim 13, wherein said first vibration driver vibrates at a first frequency and first magnitude, and wherein said second vibration driver vibrates at a second frequency and a second magnitude.

15. The system according to claim 13, wherein said first frequency is substantially equal to said second frequency.

16. The system according to claim 13, wherein said first magnitude substantially equal to and in an opposite direction to said second magnitude.

17. The system according to claim 13, wherein first and second filtering system are mounted symmetric to each other.

* * * * *